US006198442B1

(12) United States Patent
Rutkowski et al.

(10) Patent No.: US 6,198,442 B1
(45) Date of Patent: Mar. 6, 2001

(54) MULTIPLE FREQUENCY BAND BRANCH ANTENNAS FOR WIRELESS COMMUNICATORS

(75) Inventors: Kim Rutkowski, Raleigh; Gerard James Hayes, Wake Forest, both of NC (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/359,250

(22) Filed: Jul. 22, 1999

(51) Int. Cl.[7] ..... H01Q 1/24

(52) U.S. Cl. ..... 343/702; 343/895; 343/722; 343/725

(58) Field of Search ..... 343/895, 702, 343/749, 722, 725, 729, 700 MS

(56) References Cited

U.S. PATENT DOCUMENTS 5,635,945 * 6/1997 McConnell et al. ..... 343/895
5,706,019 * 1/1998 Darden, IV et al. ..... 343/895
5,936,587 * 10/1999 Gudilev et al. ..... 343/752
5,969,684 * 10/1999 Oh et al. ..... 343/702

* cited by examiner

*Primary Examiner*—Don Wong
*Assistant Examiner*—Ephrem Alemu
(74) *Attorney, Agent, or Firm*—Myers Bigel Sibley & Sajovec

(57) ABSTRACT

A multiple frequency band antenna for a communications device, such as a radiotelephone, includes a dielectric substrate having high and low frequency band radiating elements disposed on a surface thereof. The high and low frequency band radiating elements have meandering patterns and are electrically connected to a feed point. Lumped electrical elements are electrically connected in series between the high and low frequency band radiating elements at the feed point to reduce coupling effects between the high and low frequency band radiating elements.

21 Claims, 4 Drawing Sheets

MULTIPLE FREQUENCY BAND BRANCH ANTENNAS FOR WIRELESS COMMUNICATORS

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems.

Radiotelephones typically include an antenna for transmitting and/or receiving wireless communications signals. Historically, monopole and dipole antennas have perhaps been most widely employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11–12 centimeters in length. As a result, antennas utilized by radiotelephones have also undergone miniaturization. In addition, it is becoming desirable for radiotelephones to be able to operate within widely separated frequency bands in order to utilize more than one communications system. For example, GSM (Global System for Mobile communication) is a digital mobile telephone system that typically operates at a low frequency band, such as between 880 MHz and 960 MHz. DCS (Digital Communications System) is a digital mobile telephone system that typically operates at high frequency bands between 1710 MHz and 1880 MHz.

Small radiotelephone antennas typically operate within narrow frequency bands. As a result, it can be difficult for conventional radiotelephone antennas to operate over widely separated frequency bands. Furthermore, as radiotelephone antennas become smaller, the frequency bands within which they can operate typically become narrower.

Helix antennas are increasingly being utilized in handheld radiotelephones that operate within multiple frequency bands. Helix antennas typically include a conducting member wound in a helical pattern. As the radiating element of a helix antenna is wound about an axis, the axial length of the helix antenna can be considerably less than the length of a comparable monopole antenna. Thus, helix antennas may often be employed where the length of a monopole antenna is prohibitive.

FIG. 1 illustrates a conventional helix antenna 5 configured for dual frequency band operation. As shown in FIG. 1, the antenna 5 generally includes an antenna feed structure 6, a radiating element 7, and a parasitic element 8. The radiating element 7 and parasitic element 8 are housed within a plastic tube or radome 9 with an end cap 10. Unfortunately, helix antennas can be somewhat complex to manufacture, particularly with regard to positioning of the radiating and parasitic elements 7, 8.

Branch antennas are also being utilized in handheld radiotelephones that operate within multiple frequency bands. Branch antennas typically include a pair of conductive traces disposed on a substrate that serve as radiating elements and that diverge from a single feed point. FIG. 2 illustrates a conventional branch antenna 15 configured for dual frequency band operation. As shown in FIG. 2, the antenna 15 generally includes a flat substrate 16 having a pair of meandering radiating elements 17*a*, 17*b* disposed thereon. The meandering radiating elements 17*a*, 17*b* diverge from a feed point 18 that electrically connects the antenna 15 to RF circuitry within a radiotelephone. Each of the meandering radiating elements 17*a*, 17*b* is configured to resonate within a respective frequency band.

Unfortunately, branch antennas may transmit and receive electrical signals within a band of frequencies that are too narrow for radiotelephone operation. Furthermore, in order to decrease the size of a branch antenna, it is typically necessary to compress the meandering pattern of each radiating element. Unfortunately, as the meandering pattern of a radiating element becomes more compressed, the frequency band within which the radiating element can operate typically becomes more narrow.

Thus, in light of the above-mentioned demand for multiple frequency band radiotelephones and the problems with conventional antennas for such radiotelephones, a need exists for small radiotelephone antennas that are capable of operating in multiple widely separated frequency bands.

SUMMARY OF THE INVENTION

It is, therefore, an object of the present invention to provide small antennas for wireless communicators, such as radiotelephones, that are capable of operating in multiple widely separated frequency bands.

It is also an object of the present invention to facilitate radiotelephone miniaturization.

These and other objects of the present invention can be provided by a branch antenna having a dielectric substrate with high and low frequency band radiating elements that are controllably coupled with each other disposed on a surface thereof. The high and low frequency band radiating elements have meandering patterns and are electrically connected to a feed point that electrically connects the antenna to RF circuitry within a communications device. Lumped electrical elements are electrically connected in series between the high and low frequency band radiating elements and the feed point to reduce coupling effects between the high and low frequency band radiating elements. Preferably, a capacitor is electrically connected in series with the high frequency band radiating element to increase resonant bandwidth thereof. Preferably, an inductor is electrically connected in series with the low frequency band radiating element to increase resonant bandwidth thereof.

According to another embodiment of the present invention, a dielectric substrate having a folded configuration includes a pair of high and low frequency band radiating elements disposed on various sides thereof. A low frequency band radiating element is disposed on a first side of the dielectric substrate and is electrically connected to a feed point that is also located on the first side. A high frequency band radiating element is disposed on a first side of the dielectric substrate and is electrically connected to the feed point. A portion of the high frequency band radiating element is disposed on a second side of the folded substrate opposite from the first side.

A first lumped electrical element is disposed on the dielectric substrate first side and is electrically connected in series with the high frequency band radiating element at the feed point. A second lumped electrical element is disposed on the dielectric substrate first side and is electrically connected in series with the low frequency band radiating element at the feed point.

Antennas according to the present invention are particularly well suited for operation within various communications systems utilizing multiple, widely separated frequency bands. Furthermore, because of their small size, antennas according to the present invention can be utilized within very small communications devices.

DETAILED DESCRIPTION OF THE INVENTION

Figure 1:
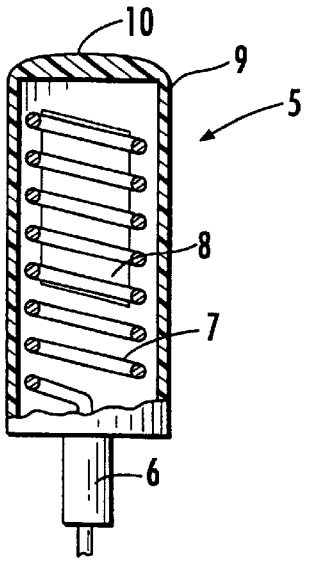
FIG. 1. (PRIOR ART)
FIG. 1 is a side section view of a conventional helix antenna that is configured for dual frequency band radiotelephone operation.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present. Moreover, each embodiment described and illustrated herein includes its complementary conductivity type embodiment as well.

Figure 3:
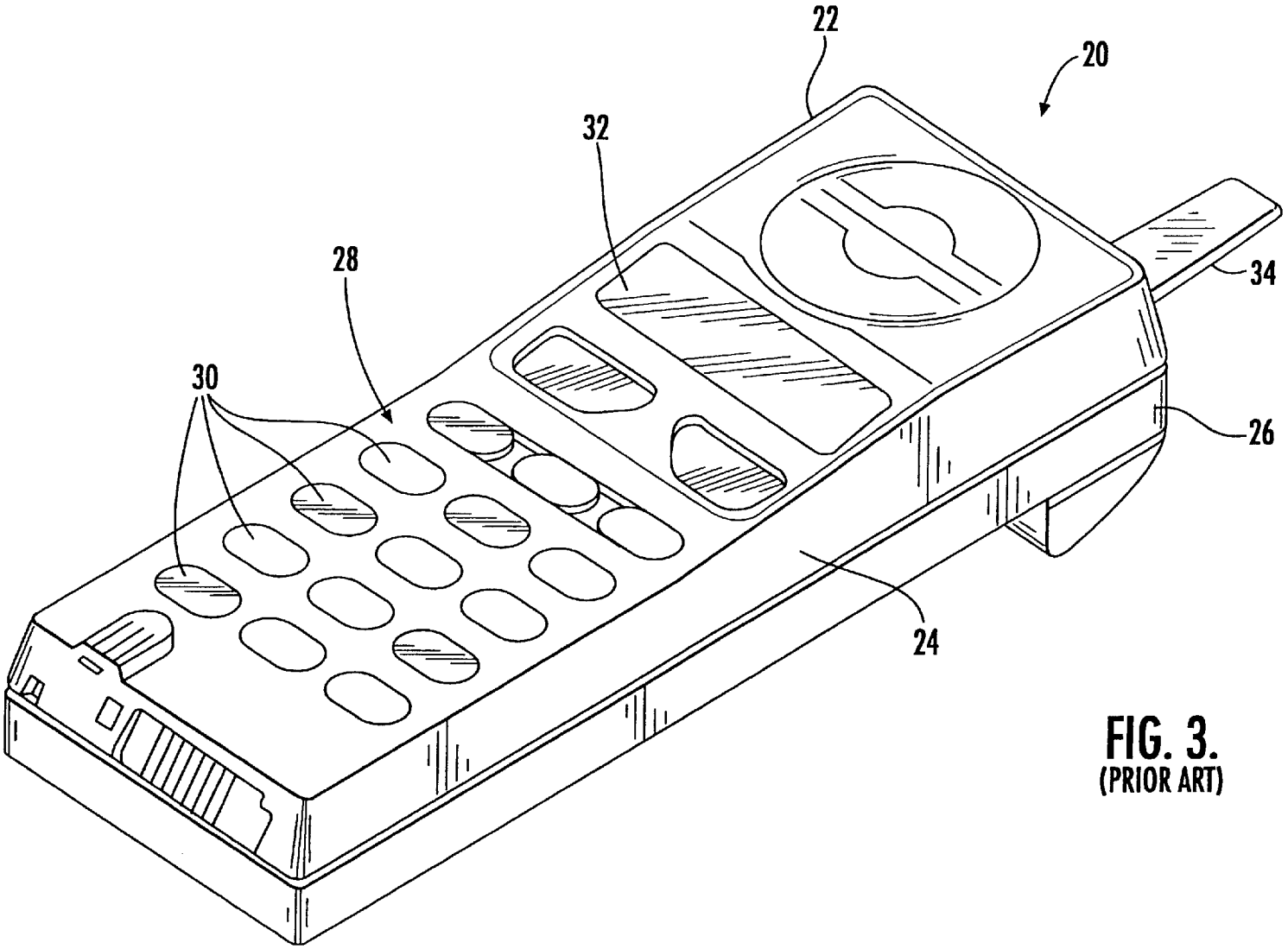
FIG. 3. (PRIOR ART)
FIG. 3 is a perspective view of an exemplary radiotelephone within which an antenna may be provided according to the present invention.

Referring now to FIG. 3, a radiotelephone 20 within which an antenna according to the present invention may be incorporated is illustrated. The housing 22 of the illustrated radiotelephone 20 includes a top portion 24 and a bottom portion 26 connected thereto to form a cavity therein. Top and bottom housing portions 24, 26 house a keypad 28 including a plurality of keys 30, a display 32, and electronic components (not shown) that enable the radiotelephone 20 to transmit and receive radiotelephone communications signals. An antenna according to the present invention may be located within the illustrated radome 34.

Figure 4:
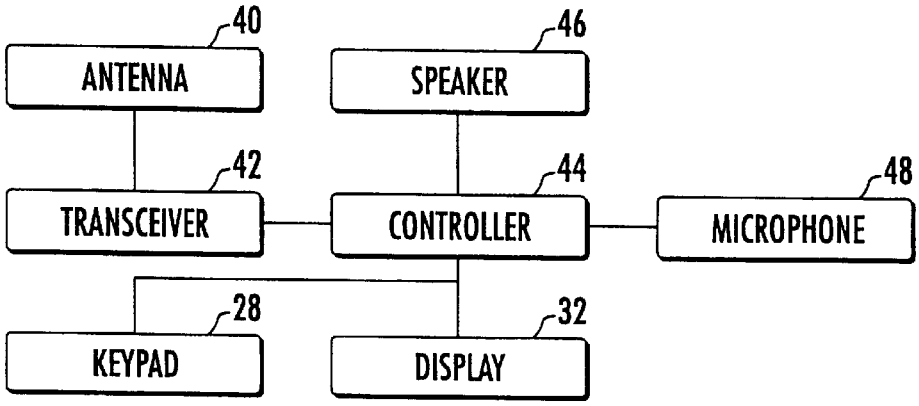
FIG. 4. (PRIOR ART)
FIG. 4 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 4, and is understood by those skilled in the art of radiotelephone communications. An antenna 40 for receiving and transmitting radiotelephone communication signals is electrically connected to a radio-frequency transceiver 42 that is further electrically connected to a controller 44, such as a microprocessor. The controller 44 is electrically connected to a speaker 46 that transmits a remote signal from the controller 44 to a user of a radiotelephone. The controller 44 is also electrically connected to a microphone 48 that receives a voice signal from a user and transmits the voice signal through the controller 44 and transceiver 42 to a remote device. The controller 44 is electrically connected to a keypad 28 and display 32 that facilitate radiotelephone operation.

Antennas according to the present invention may also be used with wireless communications devices which only transmit or receive radio frequency signals. Such devices which only receive signals may include conventional AM/FM radios or any receiver utilizing an antenna. Devices which only transmit signals may include remote data input devices.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the feed point.

Figure 5:
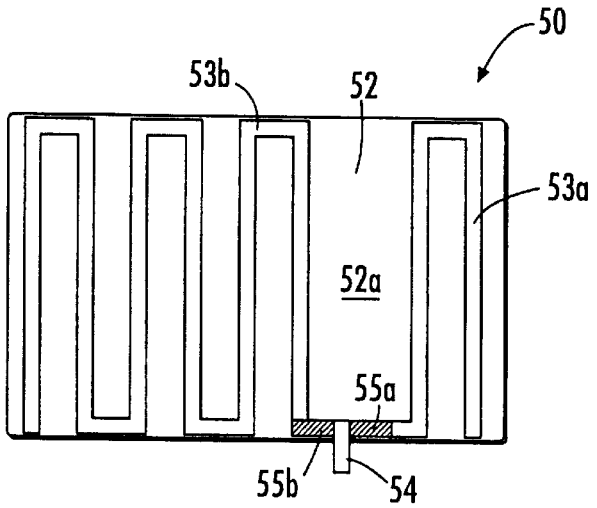
FIG. 5 is a planar view of a branch antenna according to an embodiment of the present invention that is configured for dual frequency band radiotelephone operation.

Referring now to FIG. 5, a multiple frequency band antenna 50 in accordance with an embodiment of the present invention is illustrated. The illustrated antenna 50 includes a flat dielectric substrate 52 having a pair of radiating elements (e.g., conductive copper traces) 53*a*, 53*b* disposed on a surface 52*a* thereof. The radiating elements 53*a*, 53*b* branch from and are electrically connected to a feed point 54 that electrically connects the antenna 50 to RF circuitry within a wireless communications device, such as a radiotelephone. Each radiating element 53*a*, 53*b* has a respective meandering pattern with a respective electrical length that is configured to resonate within a respective frequency band, preferably one high and one low. For example, radiating element 53*b* can be configured to resonate between 824 MHz and 960 MHz. Radiating element 53*a* can be configured to resonate between 1710 MHz and 1990 MHz.

A particularly preferable material for use as the dielectric substrate 52 is FR4 or polyimide, which is well known to those having skill in the art of communications devices. However, various dielectric materials may be utilized for the dielectric substrate 52. Preferably, the dielectric substrate 52 has a dielectric constant between about 2 and about 4 for the illustrated embodiment. However, it is to be understood that dielectric substrates having different dielectric constants may be utilized without departing from the spirit and intent of the present invention.

The size and shape of the dielectric substrate 52 is a tuning parameter. Dimensions of the illustrated high and low frequency band radiating elements 53*a*, 53*b* may vary depending on the space limitations of the substrate surface 52*a*. A preferred conductive material for use as a radiating element is copper. The thickness of the high and low frequency band radiating elements 53*a*, 53*b* is typically between about 1.0 millimeters (mm)–0.05 millimeters (mm); however, the high and low frequency band radiating elements 53*a*, 53*b* may have other thicknesses.

The electrical length of the high and low frequency band radiating elements 53*a*, 53*b* also is a tuning parameter, as is known to those skilled in the art. The bandwidth of the antenna 50 may be adjusted by changing the shape and configuration of the meandering patterns of the high and low frequency band radiating elements 53*a*, 53*b*, as would be known to those skilled in the art.

A first lumped electrical element 55*a* is electrically connected in series with the first radiating element 53*a* at the feed point 54, as illustrated. Similarly, a second lumped electrical element 55*b* is electrically connected in series with the second radiating element 53*b* at the feed point 54, as illustrated. The lumped elements 55*a*, 55*b* are configured to reduce coupling effects between the first and second radiating elements 53*a*, 53*b*.

As is known to those of skill in the art, the term "coupling" refers to the association of two or more circuits or systems in such as way that power or signal information may be transferred from one to another. The first and second radiating elements 53*a*, 53*b*, because of their close proximity to each other, experience coupling therebetween which can reduce the bandwidth capability of the antenna 50. The lumped elements 55*a*, 55*b* help reduce coupling, thereby expanding the bandwidth of the antenna 50.

As is known to those of skill in the art, a lumped electrical element is one whose physical size is substantially less than the wave length of the electromagnetic field passing through the element. As an example, a lumped element in the form of an inductor would have a physical size which is a relatively small fraction of the wave length used with the circuit, typically less than ⅛ of the wavelength.

Preferably, the first lumped electrical element 55*a* is a capacitor that is configured to increase resonant bandwidth of both the first and second radiating elements 53*a*, 53*b*. Preferably, the second lumped electrical element 55*b* is an inductor that is configured to increase resonant bandwidth of both the first and second radiating elements 53*a*, 53*b*.

A capacitor in series has a low impedance at high frequencies and a high impedance at low frequencies. Thus, when a capacitor is placed in series with the high frequency band radiating element 53*a* of the illustrated branch antenna 50, low frequencies are blocked by the high impedance of the capacitor while high frequencies are allowed to radiate. Conversely, an inductor in series has a low impedance at low frequencies and a high impedance at high frequencies. When an inductor is placed in series with the low frequency band radiating element 53*b* of the illustrated branch antenna 50, high frequencies are blocked by the high impedance of the inductor while low frequencies are allowed to radiate.

In addition, the capacitor 55*a* and inductor 55*b* present a phase shift to each respective radiating element 53*a*, 53*b*. For example, when referenced to the feed point 54, the second radiating element 53*b* can have a positive 90° phase shift and the first radiating element 53*a* can have a negative 90° phase shift. Because the radiating elements 53*a*, 53*b* are not in phase with each other, they experience less coupling.

Although the illustrated branch antenna 50 utilizes both a capacitor 55*a* and inductor 55*b*, it is understood that an inductor or capacitor may be utilized individually depending on the electrical requirements of an antenna.

The low frequency bands of GSM are between about 880 MHz and 960 MHz, corresponding to a bandwidth of 80 MHz. The low frequency bands of AMPS (Advanced Mobile Phone Service) are between about 824 MHz and 894 MHz, corresponding to a bandwidth of 70 MHz. The high frequency bands of PCS (Personal Communications System) are between about 1850 MHz and 1990 MHz, corresponding to a bandwidth of 140 MHz. The high frequency bands of DCS are between about 1710 MHz and 1880 MHz, corresponding to a bandwidth of 170 MHz. Accordingly, for a radiotelephone antenna to operate adequately at a low frequency band (e.g., for GSM or AMPS), it should have a bandwidth of between about 70 MHz–80 MHz. Similarly, for a radiotelephone antenna to operate adequately at a high frequency band (e.g., for PCS or DCS), it should have a bandwidth of between about 140 MHz–170 MHz.

Figure 2:
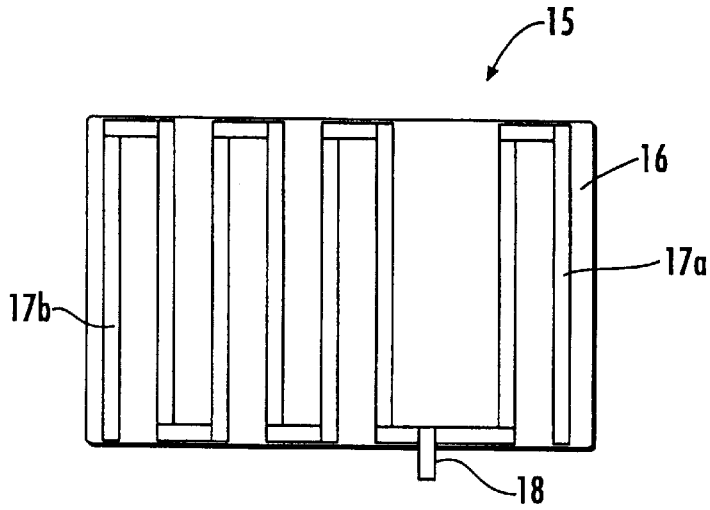
FIG. 2. (PRIOR ART)
FIG. 2 is a plan view of a conventional branch antenna that is configured for dual frequency band radiotelephone operation.

Table 1 below illustrates the bandwidth attainable by a conventional branch antenna, such as that illustrated in FIG. 2, and a branch antenna according to the present invention, such as that illustrated in FIG. 5. The branch antenna of FIG. 2 that does not contain any lumped electrical elements in series with the high and low frequency band radiating elements 17*a*, 17*b* has a low band center of frequency of 863.3 MHz with a bandwidth of 30.5 MHz at a VSWR of 2 or below (to facilitate impedance matching). The branch antenna of FIG. 2 also has a high band center of frequency of 1994.8 MHz with a bandwidth of only 19 at a VSWR of 2. Accordingly, the branch antenna 10 of FIG. 2 does not meet the bandwidth requirements of 70 MHz–80 MHz and 140MHz–170 MHz.

TABLE 1

| | Low Band | | High Band | |
|---|---|---|---|---|
| | Center Frequency of Resonance (MHZ) | Bandwidth (MHz) of 2:1 VSWR | Center Frequency of Resonance (MHz) | Bandwidth (MHz of 2:1 VSWR |
| Branch Antenna Without Lumped Elements | 863.3 | 30.5 | 1994.8 | 19 |
| Antenna With 1pF Capacitor In Series With High Frequency Band Radiating Element | 906 | 70.8 | 1580 | 225 |
| Antenna With 1pF Capacitor In Series With High Frequency Band Radiating Element and 22nH Inductor in Series With Lowe Frequency Band Radiating Element | 905 | 70.8 | 1560 | 240 |

Still referring to Table 1 a branch antenna having a 1 picoFarad (pF) capacitor placed in series with the high frequency band radiating element has a low band center frequency of 906 MHz with a bandwidth of 70.8 MHz and a high band center frequency of 1580 MHz with a bandwidth of 225. A branch antenna, such as that illustrated in FIG. 5, having a 1 pF capacitor placed in series with the high frequency band radiating element 53*a* and a 22 nanoHenry (nH) inductor placed in series with the low frequency band radiating element 53*b* has a low band center frequency of 905 MHz with a bandwidth of 70.8 MHz and a high band center frequency of 1560 MHz with a bandwidth of 240. Accordingly, as illustrated in Table 1, a branch antenna having one or more lumped elements in series with its radiating elements can have adequate bandwidth for operation within the widely separated frequency bands of GSM, AMPS, PCS and DCS. Accordingly antennas according to the present invention are particularly well suited for operation within various communications systems utilizing multiple, widely separated frequency bands.

Figure 6A:
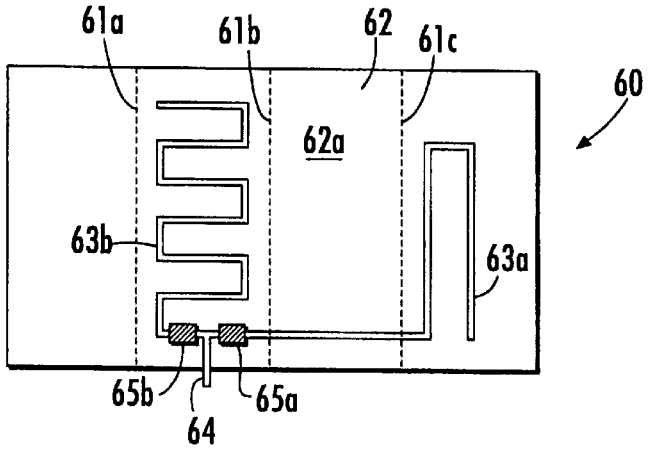
FIG. 6A is a planar view of a branch antenna according to another embodiment of the present invention that is configured for dual frequency band radiotelephone operation.
Figure 6B:
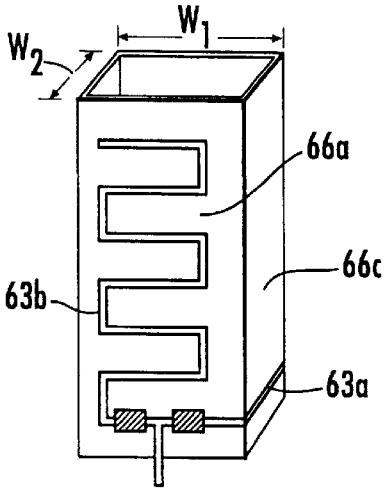
FIGS. 6B–6C are respective front and rear perspective views of the branch antenna of FIG. 6A folded into a rectangular configuration.
Figure 6C:
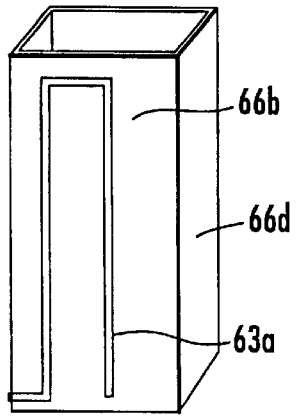

Referring now to FIGS. 6A–6C, a multiple frequency band antenna 60 according to another embodiment of the present invention is illustrated. FIG. 6A is a plan view of a branch antenna 60 that is configured to be folded into a four-sided rectangular configuration. The illustrated antenna 60 includes a flat dielectric substrate 62 having a pair of radiating elements (i.e., conductive traces) 63*a*, 63*b* disposed on a surface 62*a* thereof. The radiating elements 63*a*, 63*b* branch from and are electrically connected to a feed point 64.

The illustrated high frequency band radiating element 63*a* has less of a meandering pattern than the illustrated low frequency band radiating element 63*b* and is preferably configured to resonate within a high frequency band, such as between 1710 MHz and 1990 MHz. The low frequency band radiating element 63*b* is preferably configured to resonate within a low frequency band, such as between 824 MHz and 960 MHz.

A first lumped electrical element 65*a* is electrically connected in series with the high frequency band radiating element 63*a* at the feed point 64, as illustrated. Similarly, a second lumped electrical element 65*b* is electrically connected in series with the low frequency band radiating element 63*b* at the feed point 64, as illustrated. As described above, the lumped elements 65*a*, 65*b* are configured to reduce coupling effects between the high and low frequency band radiating elements 63*a*, 63*b*.

The illustrated branch antenna 60 is configured to be folded along fold lines 61*a*, 61*b*, 61*c* to achieve the four-sided rectangular configuration illustrated in FIGS. 6B and 6C. As illustrated in FIGS. 6B and 6C, the antenna 60 includes opposite first and second sides 66*a*, 66*b* and opposite third and fourth sides 66*c*, 66*d*. An exemplary width $W_1$ of the first and second sides 66*a*, 66*b*is between about 4 mm and about 15 mm. An exemplary width $W_2$ of the third and fourth sides 66*c*, 66*d* is between about 4 mm and about 15 mm.

As illustrated in FIG. 6B the low frequency band radiating element 63*b*, feed point 64 and lumped electrical elements 65*a*, 65*b* are disposed on the first side 66*a* of the dielectric substrate 62. The high frequency band radiating element 63*b* extends along the third side 66*c* and a portion of the high frequency band radiating element 63*a* is disposed on the second side 66*b*.

Figure 7A:
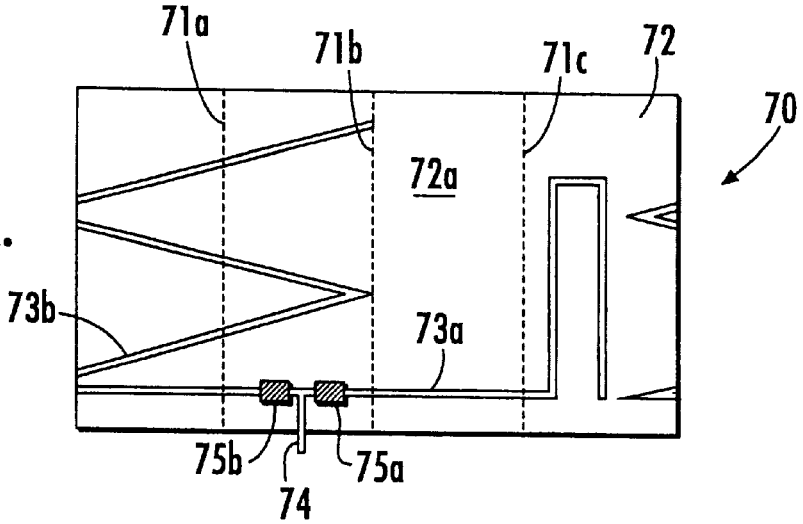
FIG. 7A is a planar view of a branch antenna according to another embodiment of the present invention that is configured for dual frequency band radiotelephone operation.
Figure 7B:
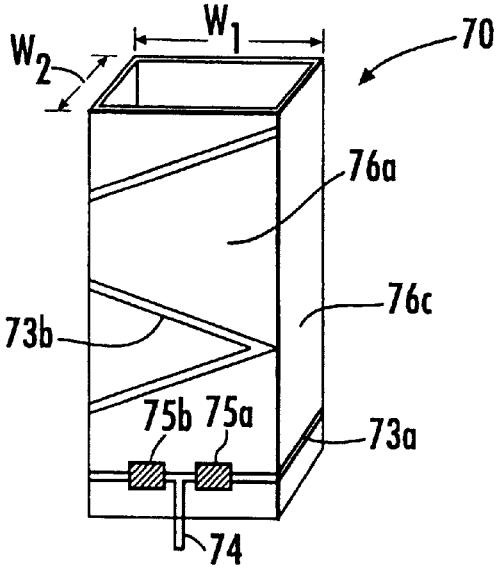
FIGS. 7B–7C are respective front and rear perspective views of the branch antenna of FIG. 7A folded into a rectangular configuration.
Figure 7C:
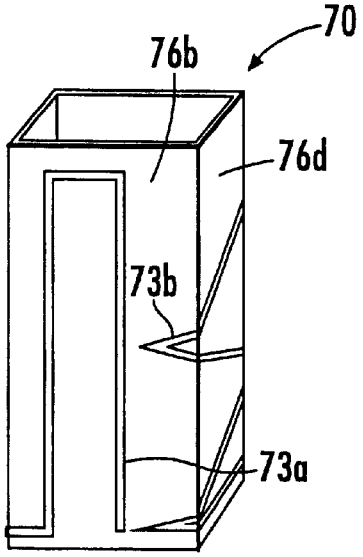

Referring now to FIGS. 7A–7C, a multiple frequency band antenna 70 according to another embodiment of the present invention is illustrated. FIG. 7A is a plan view of a branch antenna 70 that is configured to be folded into a four-sided rectangular configuration. The illustrated antenna 70 includes a flat dielectric substrate 72 having a pair of radiating elements (i.e., conductive traces) 73*a*, 73*b* disposed on a surface 72*a* thereof. The radiating elements 73*a*, 73*b* branch from and are electrically connected to a feed point 74.

The high frequency band radiating element 73*a* has less of a meandering pattern than the low frequency band radiating element 73*b* and is preferably configured to resonate within a high frequency band, such as between 1710 MHz and 1990 MHz. The low frequency band radiating element 73*b* is preferably configured to resonate within a low frequency band, such as between 824 MHz and 960 MHz.

A first lumped electrical element 75*a* is electrically connected in series with the high frequency band radiating element 73*a* at the feed point 74, as illustrated. Similarly, a second lumped electrical element 75*b* is electrically connected in series with the low frequency band radiating element 73*b* at the feed point 74, as illustrated. As described above, the lumped elements 75*a*, 75*b* are configured to reduce coupling effects between the high and low frequency band radiating elements 73*a*, 73*b*.

The illustrated branch antenna 70 is configured to be folded along fold lines 71*a*, 71*b*, 71*c* to achieve the four-sided rectangular configuration illustrated in FIGS. 7B and 7C. As illustrated in FIGS. 7B and 7C, the antenna 70 includes opposite first and second sides 76*a*, 76*b* and opposite third and fourth sides 76*c*, 76*d*. An exemplary width $W_2$, of the first and second sides 76*a*, 76*b* is between about 4 mm and about 15 mm. An exemplary width $W_2$ of the third and fourth sides 76*c*, 76*d* is between about 4 mm and about 15 mm.

As illustrated in FIG. 7B the low frequency band radiating element 73*b*, feed point 74 and lumped electrical elements 75*a*, 75*b* are disposed on the first side 76*a* of the dielectric substrate 72. The high frequency band radiating element 73*a* extends along the third side 76*c* and a portion of the high frequency band radiating element 73*a* is disposed on the second side 76*b*. In addition, the low frequency band radiating element 73*b* extends along the fourth side 76*d* and a portion of the low frequency band radiating element 73*b* is disposed on the second side 76*b*.

It is to be understood that the present invention is not limited to the illustrated embodiments of FIGS. 5, 6A–6C and 7A–7C. Various other configurations incorporating aspects of the present invention may be utilized, without limitation. For example, the folded configuration of FIGS. 6A–6C and 7A–7C are not limited to rectangular configurations.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A wireless communicator, comprising:

a housing configured to enclose a transceiver that transmits and receives wireless communications signals; and a multiple frequency band antenna electrically connected with the transceiver, comprising:

a dielectric substrate, wherein the dielectric substrate has a folded configuration with opposite first and second sides and opposite third and fourth sides;

a feed point disposed on the dielectric substrate first side;

a first radiating element disposed on the dielectric substrate first side and electrically connected to the feed point, wherein the first radiating element comprises a first electrically conductive path having a first meandering configuration, and wherein the first radiating element is configured to resonate within a first frequency band;

a second radiating element disposed on the dielectric substrate second and third sides and electrically connected to the feed point, wherein the second radiating element comprises a second electrically conductive path having a second meandering configuration that is different from the first meandering configuration, and wherein the second radiating element is configured to resonate within a second frequency band that is different than the first frequency band; and at least one lumped electrical element electrically connected in series between the feed point and at least one of the first and second radiating elements, wherein the lumped element is configured to reduce coupling effects between the first and second radiating elements.

2. A wireless communicator according to claim 1 wherein the at least one lumped electrical element comprises:

a first lumped electrical element electrically connected in series between the first radiating element and the feed point; and a second lumped electrical element electrically connected in series between the second radiating element and the feed point.

3. A wireless communicator according to claim 2 wherein the first lumped electrical element comprises a capacitor that is configured to increase resonant bandwidth of the first and second radiating elements, and wherein the second lumped electrical element comprises an inductor that is configured to increase resonant bandwidth of at least one of the first and second radiating elements.

4. A wireless communicator according to claim 1 wherein the first and second radiating elements have different electrical lengths.

5. A wireless communicator according to claim 1 wherein the wireless communicator comprises a radiotelephone.

6. A wireless communicator, comprising:

a housing configured to enclose a transceiver that transmits and receives wireless communications signals; and a multiple frequency band antenna electrically connected with the transceiver, comprising:

a dielectric substrate, wherein the dielectric substrate has a folded configuration with opposite first and second sides and opposite third and fourth sides;

a feed point disposed on the dielectric substrate first side;

a first radiating element disposed on at least the dielectric substrate first and fourth sides and electrically connected to the feed point, wherein the first radiating element comprises a first electrically conductive path having a first meandering configuration, and wherein the first radiating element is configured to resonate within a first frequency band;

a second radiating element disposed on the dielectric substrate second and third sides and electrically connected to the feed point, and wherein the second radiating element comprises a second electrically conductive path having a second meandering configuration that is different from the first meandering configuration, and wherein the second radiating element is configured to resonate within a second frequency band different than the first frequency band; and at least one lumped electrical element disposed on the dielectric substrate first side and electrically connected in series between the feed point and at least one of the first and second radiating elements, wherein the at least one lumped element is configured to reduce coupling effects between the first and second radiating elements.

7. A wireless communicator according to claim 6 wherein the first radiating element is disposed on the first, second, and fourth sides of the dielectric substrate.

8. A wireless communicator according to claim 6 wherein the first and second radiating elements have different electrical lengths.

9. A wireless communicator according to claim 6 wherein the wireless communicator comprises a radiotelephone.

10. A wireless communicator according to claim 6 wherein the at least one lumped electrical element comprises:

a first lumped electrical element disposed on the dielectric substrate first side and electrically connected in series between the first radiating element and the feed point; and a second lumped electrical element disposed on the dielectric substrate first side and electrically connected in series between the second radiating element and the feed point.

11. A wireless communicator according to claim 10 wherein the first lumped electrical element comprises a capacitor that is configured to increase resonant bandwidth of the first and second radiating elements, and wherein the second lumped electrical element comprises an inductor that is configured to increase resonant bandwidth of at least one of the first and second radiating elements.

12. A multiple frequency band antenna, comprising:

a dielectric substrate, wherein the dielectric substrate has a folded configuration with opposite first and second sides and opposite third and fourth sides;

a feed point disposed on the dielectric substrate first side;

a first radiating element disposed on the dielectric substrate first side and electrically connected to the feed point, wherein the first radiating element comprises a first electrically conductive path having a first meandering configuration, and wherein the first radiating element is configured to resonate within a first frequency band;

a second radiating element disposed on the dielectric substrate second and third sides and electrically connected to the feed point, wherein the second radiating element comprises a second electrically conductive path having a second meandering configuration that is different from the first meandering configuration, and wherein the second radiating element is configured to resonate within a second frequency band that is different than the first frequency band; and at least one lumped electrical element electrically connected in series between the feed point and at least one of the first and second radiating elements, wherein the at least one lumped element is configured to reduce coupling effects between the first and second radiating elements.

13. A multiple frequency band antenna according to claim 12 wherein the first and second radiating elements have different electrical lengths.

14. A multiple frequency band antenna according to claim 12 wherein the at least one lumped electrical element comprises:

a first lumped electrical element electrically connected in series between the first radiating element and the feed point; and a second lumped electrical element electrically connected in series between the second radiating element and the feed point.

15. A multiple frequency band antenna according to claim 14 wherein the first lumped electrical element comprises a capacitor that is configured to increase resonant bandwidth of both the first and second radiating elements, and wherein the second lumped electrical element comprises an inductor that is configured to increase resonant bandwidth of at least one of the first and second radiating elements.

16. A multiple frequency band antenna, comprising:

a dielectric substrate, wherein the dielectric substrate has a folded configuration with opposite first and second sides and opposite third and fourth sides;

a feed point disposed on the dielectric substrate first side;

a first radiating element disposed on at least the dielectric substrate first and fourth sides and electrically connected to the feed point, wherein the first radiating element comprises a first electrically conductive path having a first meandering configuration, and wherein the first radiating element is configured to resonate within a first frequency band;

a second radiating element disposed on the dielectric substrate second and third sides and electrically connected to the feed point, and wherein the second radiating element comprises a second electrically conductive path having a second meandering configuration that is different from the first meandering configuration, and wherein the second radiating element is configured to resonate within a second frequency band different than the first frequency band; and at least one lumped electrical element disposed on the dielectric substrate first side and electrically connected in series between the feed point and at least one of the first and second radiating elements, wherein the at least one lumped element is configured to reduce coupling effects between the first and second radiating elements.

17. A multiple frequency band antenna according to claim 16 wherein the first radiating element is disposed on the first, second, and fourth sides of the dielectric substrate.

18. A multiple frequency band antenna according to claim 16 wherein the first and second radiating elements have different electrical lengths.

19. A multiple frequency band antenna according to claim 16 wherein at least one of the first and second radiating elements comprises a meandering configuration.

20. A multiple frequency band antenna according to claim 16 wherein the at least one lumped electrical element further comprises:

a first lumped electrical element disposed on the dielectric substrate first side and electrically connected in series between the first radiating element and the feed point; and a second lumped electrical element disposed on the dielectric substrate first side and electrically connected in series between the second radiating element and the feed point.

21. A multiple frequency band antenna according to claim 20 wherein the first lumped electrical element comprises a capacitor that is configured to increase resonant bandwidth of both the first and second radiating elements and wherein the second lumped electrical element comprises an inductor that is configured to increase resonant bandwidth of at least one of the first and second radiating elements.

* * * * *